US009072416B2

(12) United States Patent
Kowalski

(10) Patent No.: US 9,072,416 B2
(45) Date of Patent: Jul. 7, 2015

(54) VACUUM CLEANER AGITATOR CLEANER WITH BRUSHROLL LIFTING MECHANISM

(71) Applicant: AKTIEBOLAGET ELECTROLUX, Stockholm (SE)

(72) Inventor: Gregory James Kowalski, Cornelius, NC (US)

(73) Assignee: Aktiebolaget Electrolux (SE)

( * ) Notice: Subject to any disclaimer, the term of this patent is extended or adjusted under 35 U.S.C. 154(b) by 344 days.

(21) Appl. No.: 13/838,035

(22) Filed: Mar. 15, 2013

(65) Prior Publication Data

US 2014/0259521 A1 Sep. 18, 2014

(51) Int. Cl.
*A47L 9/04* (2006.01)
*A47L 5/30* (2006.01)

(52) U.S. Cl.
CPC ..... *A47L 9/0477* (2013.01); *A47L 5/30* (2013.01); *A47L 9/0494* (2013.01)

(58) Field of Classification Search
CPC ... A47L 9/0477; A47L 9/0494; A47L 9/0488; A47L 9/066; A47L 5/34; A47L 5/30; A47L 7/0057
USPC ..... 15/383, 386
See application file for complete search history.

(56) References Cited

U.S. PATENT DOCUMENTS

| | | | |
|---|---|---|---|
| 804,213 | A | 11/1905 | Chaplin |
| 969,441 | A | 9/1910 | Backer |
| 1,231,077 | A | 6/1917 | Scheffler |
| 1,268,963 | A | 6/1918 | Gray |
| 1,412,420 | A | 4/1922 | Polansky |
| 1,757,461 | A | 5/1930 | Losey |
| 1,813,325 | A | 7/1931 | Smith |
| 1,820,350 | A | 8/1931 | Dance |
| 1,907,692 | A | 5/1933 | White |
| 1,965,614 | A | 7/1934 | Sellers |

(Continued)

FOREIGN PATENT DOCUMENTS

| | | |
|---|---|---|
| CN | 1593320 | 3/2005 |
| CN | 1816301 | 8/2006 |

(Continued)

OTHER PUBLICATIONS

International Search Report for PCT International Application No. PCT/EP2011/068743 dated Jun. 14, 2012.

(Continued)

*Primary Examiner* — Lee D Wilson
*Assistant Examiner* — Henry Hong
(74) *Attorney, Agent, or Firm* — RatnerPrestia

(57) ABSTRACT

A vacuum cleaner having a base, an agitator, a motor, an agitator cleaner, first and second support assemblies, and an actuator. The agitator cleaner is movable to be spaced from the agitator or to engage the agitator to remove debris while the motor rotates the agitator. The support assemblies collectively support the base on a surface to be cleaned, and the first support assembly is movable between a raised position in which the agitator is proximal to the surface and a lowered position in which the agitator is spaced from the surface. The actuator is movable between an idle position and an operative position. The actuator has a first controller to move the agitator cleaner into the first position when the actuator is in the idle position, and a second controller to move the first support assembly to the lowered position when the actuator is in the operative position.

20 Claims, 6 Drawing Sheets

(56) References Cited

U.S. PATENT DOCUMENTS

| | | | | |
|---|---|---|---|---|
| 1,999,696 | A | 4/1935 | Kitto | |
| 2,032,345 | A | 3/1936 | Cranon | |
| 2,625,698 | A | 1/1953 | De Kadt | |
| 2,642,601 | A | 6/1953 | Saffioti | |
| 2,642,617 | A | 6/1953 | Lilly | |
| 2,663,045 | A | 12/1953 | Conway | |
| 2,733,000 | A | 1/1956 | Sparklin | |
| 2,741,785 | A | 4/1956 | Siebert | |
| 2,789,306 | A | 4/1957 | Kath | |
| 2,904,818 | A | 9/1959 | Sheahan | |
| 2,960,714 | A | 11/1960 | Senne | |
| 2,975,450 | A | 3/1961 | Williams | |
| 3,470,575 | A | 10/1969 | Larson et al. | |
| 3,536,977 | A | 10/1970 | Porter | |
| 3,683,444 | A | 8/1972 | Schaefer et al. | |
| 3,722,018 | A | 3/1973 | Fisher | |
| 3,862,467 | A | 1/1975 | Krickovich | |
| 3,863,285 | A * | 2/1975 | Hukuba | 15/48 |
| 4,020,526 | A | 5/1977 | Johansson | |
| 4,171,554 | A * | 10/1979 | Tschudy | 15/359 |
| 4,173,054 | A | 11/1979 | Ando | |
| 4,193,710 | A | 3/1980 | Pietrowski | |
| 4,209,872 | A | 7/1980 | Maier | |
| 4,317,253 | A | 3/1982 | Gut | |
| 4,352,221 | A | 10/1982 | Revells et al. | |
| 4,370,690 | A | 1/1983 | Baker | |
| 4,370,777 | A | 2/1983 | Woerwag | |
| 4,372,004 | A | 2/1983 | Vermillion | |
| 4,373,228 | A | 2/1983 | Dyson et al. | |
| 4,398,231 | A | 8/1983 | Currence | |
| 4,426,751 | A | 1/1984 | Nordeen | |
| 4,573,235 | A | 3/1986 | Baird, Sr. | |
| 4,654,924 | A | 4/1987 | Getz et al. | |
| 4,702,122 | A | 10/1987 | Richard | |
| 4,802,254 | A | 2/1989 | Lahndorff et al. | |
| 4,847,944 | A | 7/1989 | Lackner | |
| 4,875,246 | A | 10/1989 | MacGregor | |
| 4,920,605 | A | 5/1990 | Takashima | |
| 4,953,253 | A | 9/1990 | Fukuda | |
| 4,989,293 | A | 2/1991 | Bashyam | |
| 5,075,922 | A | 12/1991 | Tsuchida et al. | |
| 5,115,538 | A | 5/1992 | Cochran et al. | |
| 5,121,592 | A | 6/1992 | Jertson | |
| 5,203,047 | A | 4/1993 | Lynn | |
| 5,243,732 | A | 9/1993 | Koharagi et al. | |
| 5,287,581 | A | 2/1994 | Lo | |
| 5,394,588 | A | 3/1995 | Kweon et al. | |
| 5,452,490 | A | 9/1995 | Brundula et al. | |
| 5,482,562 | A * | 1/1996 | Abernathy | 134/6 |
| 5,657,504 | A | 8/1997 | Khoury | |
| 5,974,975 | A | 11/1999 | Seefried | |
| 6,042,656 | A | 3/2000 | Knutson | |
| 6,131,238 | A | 10/2000 | Weber et al. | |
| 6,170,119 | B1 | 1/2001 | Conrad et al. | |
| 6,253,414 | B1 | 7/2001 | Bradd | |
| 6,266,838 | B1 | 7/2001 | Caruso | |
| 6,282,749 | B1 * | 9/2001 | Tajima et al. | 15/387 |
| 6,286,180 | B1 | 9/2001 | Kasper et al. | |
| 6,351,872 | B1 | 3/2002 | McCormick | |
| 6,367,120 | B2 | 4/2002 | Beauchamp | |
| 6,502,277 | B1 | 1/2003 | Petersson et al. | |
| 6,539,575 | B1 | 4/2003 | Cohen | |
| 6,539,577 | B1 | 4/2003 | Okuda et al. | |
| 6,810,559 | B2 | 11/2004 | Mertes et al. | |
| 6,883,201 | B2 | 4/2005 | Jones et al. | |
| 6,892,420 | B1 | 5/2005 | Haan et al. | |
| 7,143,461 | B2 | 12/2006 | Spooner | |
| 7,159,276 | B2 | 1/2007 | Omoto et al. | |
| 7,163,568 | B2 | 1/2007 | Sepke et al. | |
| 7,171,723 | B2 | 2/2007 | Kobayashi et al. | |
| 7,228,593 | B2 | 6/2007 | Conrad | |
| 7,237,298 | B2 | 7/2007 | Reindie et al. | |
| 7,293,326 | B2 | 11/2007 | Hawkins et al. | |
| 7,731,618 | B2 | 6/2010 | Burlington et al. | |
| 8,087,117 | B2 | 1/2012 | Kapoor et al. | |
| 8,418,303 | B2 | 4/2013 | Kapoor et al. | |
| 8,671,515 | B2 | 3/2014 | Eriksson | |
| 2002/0007528 | A1 | 1/2002 | Beauchamp | |
| 2004/0244140 | A1 | 12/2004 | Joo | |
| 2005/0015922 | A1 | 1/2005 | Lim et al. | |
| 2005/0091788 | A1 | 5/2005 | Forsberg et al. | |
| 2006/0037170 | A1 * | 2/2006 | Shimizu | 15/319 |
| 2006/0162121 | A1 | 7/2006 | Naito et al. | |
| 2006/0272122 | A1 | 12/2006 | Butler et al. | |
| 2009/0229075 | A1 * | 9/2009 | Eriksson | 15/383 |
| 2010/0205768 | A1 * | 8/2010 | Oh | 15/383 |
| 2010/0313912 | A1 | 12/2010 | Han | |
| 2013/0008469 | A1 * | 1/2013 | Yun et al. | 134/18 |
| 2013/0042429 | A1 * | 2/2013 | Misumi et al. | 15/415.1 |
| 2013/0198995 | A1 * | 8/2013 | Eriksson | 15/383 |
| 2014/0331446 | A1 * | 11/2014 | Eriksson | 15/383 |
| 2014/0359968 | A1 * | 12/2014 | Eriksson et al. | 15/390 |

FOREIGN PATENT DOCUMENTS

| | | | |
|---|---|---|---|
| EP | 0649625 | A2 | 4/1995 |
| EP | 1415583 | A1 | 5/2004 |
| EP | 1642520 | A1 | 4/2006 |
| EP | 1994869 | | 11/2008 |
| EP | 2273906 | | 1/2011 |
| EP | 2543301 | | 1/2013 |
| FR | 1068296 | | 6/1954 |
| FR | 2855742 | | 12/2004 |
| GB | 2000963 | | 1/1979 |
| GB | 2231778 | | 11/1990 |
| JP | 5095868 | | 4/1993 |
| JP | 5305044 | | 11/1993 |
| JP | 6086743 | | 3/1994 |
| WO | 9210967 | | 7/1992 |
| WO | WO 2009/117383 | | 9/2009 |
| WO | 2010041184 | | 4/2010 |

OTHER PUBLICATIONS

International Search Report for PCT International Application No. PCT/EP2012/051773 dated Sep. 17, 2012.

International Search Report for PCT International Application No. PCT/EP2012/071318 dated Jan. 3, 2013.

International Search Report for PCT International Application No. PCT/EP2012/071319 dated Dec. 11, 2012.

Supplemental European Search Report for Application No. EP 09 72 1677, Oct. 30, 2012.

Office Action for CN 200980110915.5 (with English Translation), The State Intellectual Property Office of China, Feb. 4, 2013.

International Search Report for International Application No. PCT/US2009/037348 dated May 14, 2009.

Entire patent prosecution history of U.S. Appl. No. 14/467,697, filed Aug. 25, 2014, entitled, "Actuator Mechanism for a Brushroll Cleaner."

Entire patent prosecution history of U.S. Appl. No. 13/826,630, filed Mar. 14, 2013, entitled, "Brushroll Cleaning Feature With Spaced Brushes and Friction Surfaces to Prevent Contact."

Entire patent prosecution history of U.S. Appl. No. 13/826,855, filed Mar. 14, 2013, entitled, "Brushroll Cleaning Feature With Overload Protection During Cleaning."

Entire patent prosecution history of U.S. Appl. No. 13/826,934, filed Mar. 14, 2013, entitled, "Automated Brushroll Cleaning."

Entire patent prosecution history of U.S. Appl. No. 13/835,691, filed Mar. 15, 2013, entitled, "Vacuum Cleaner Agitator Cleaner With Power Control."

Entire patent prosecution history of U.S. Appl. No. 14/462,956, filed Aug. 19, 2014, entitled, "Vacuum Cleaner Brushroll Cleaner Configuration."

Entire patent prosecution history of U.S. Appl. No. 13/826,400, filed Mar. 14, 2013, entitled, "Brushroll Cleaning Feature With Resilient Linkage to Regulate User-Applied Force," now U.S. Patent No. 8,671,515, issued Mar. 18, 2014.

Entire patent prosecution history of U.S. Appl. No. 12/405,761, filed Mar. 17, 2009, entitled, "Agitator With Cleaning Features," now U.S. Patent No. 8,601,643, issued Dec. 10, 2013.

Entire patent prosecution history of U.S. Appl. No. 14/374,119, filed Aug. 25, 2014, entitled, "Cleaning Arrangement for a Nozzle of a Vacuum Cleaner."

(56) References Cited

OTHER PUBLICATIONS

Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
International Search Report and Written Opinion for International Application No. PCT/IB2014/001050, mailed Oct. 28, 2014.
International Search Report and Written Opinion for International Application No. PCT/IB2014/001256, mailed Oct. 28, 2014.

* cited by examiner

FIG. 2A
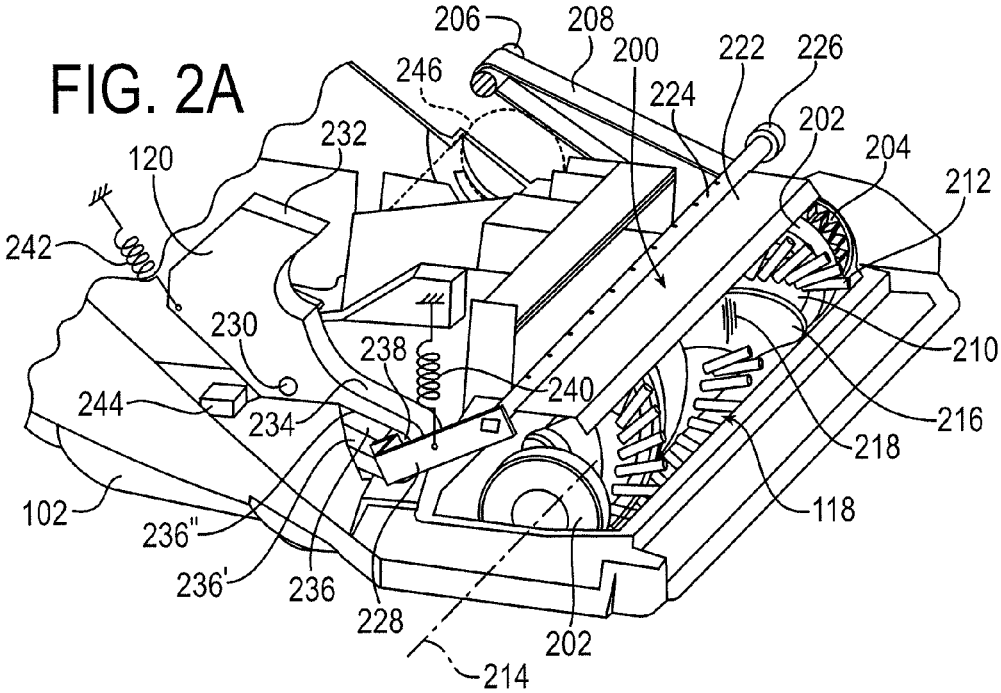
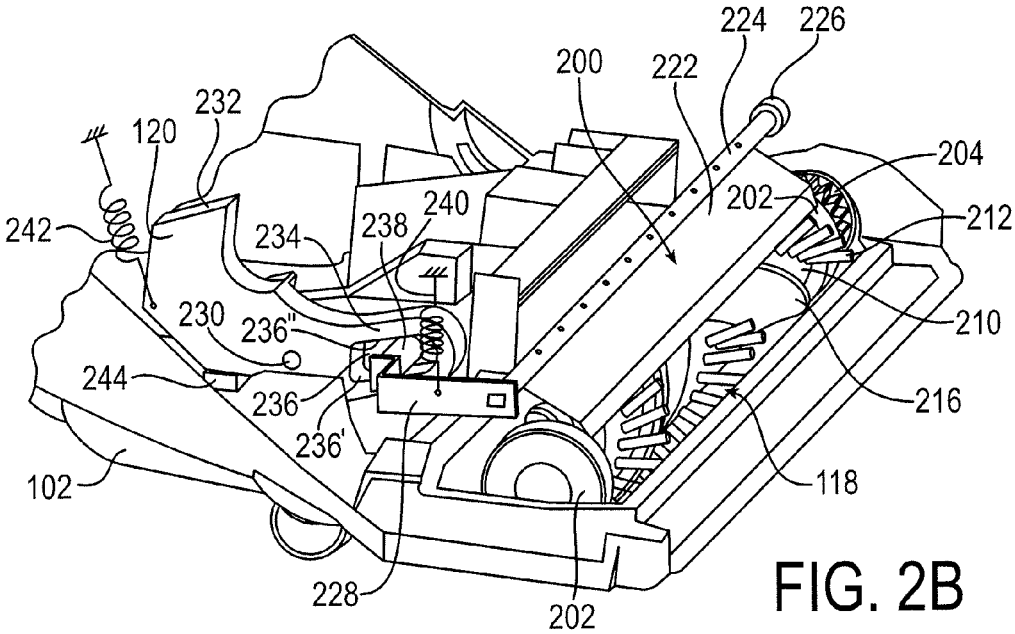
FIG. 2B

VACUUM CLEANER AGITATOR CLEANER WITH BRUSHROLL LIFTING MECHANISM

BACKGROUND OF THE INVENTION

1. Field of the Invention

The present invention relates generally to cleaning devices and, more specifically, to cleaning device agitators having features for removing dirt and debris from the agitator.

2. Description of the Related Art

It is well known in the art of cleaning devices to use agitators to clean surfaces such as carpets, upholstery, and bare floors. These agitators can function in a variety of ways and appear in many forms. One typical embodiment of an agitator is a tube or shaft that rotates around its longitudinal axis and has one or more features that agitate the surface as it rotates. Such features typically include one or more bristle tufts, flexible flaps, bumps, and so on. These are commonly referred to as "brushrolls," but other terms have been used to describe them. The agitator moves or dislodges dirt from the surface, making it easier to collect by the cleaning device. Agitators are useful in a variety of cleaning devices including vacuum cleaners, sweepers, wet extractors, and so on. In a sweeper, the agitator typically moves or throws the dirt directly into a receptacle. In a vacuum cleaner or similar device, the dirt may be entrained in an airflow generated by a vacuum within the cleaning device and thereby conveyed to a filter bag, cyclone separator or other kind of dirt collection device in the vacuum cleaner. U.S. Pat. No. 4,372,004, which reference is incorporated herein, provides an example of such an agitator.

It has been found that rotating agitators used in vacuum cleaners, floor sweepers, and the like, can collect a significant amount of various kinds of dirt and debris on the agitator itself. For example, the debris may include human and animal hairs, strings, threads, carpet fibers and other elongated fibers that wrap around or otherwise cling to the agitator. It has also been found that accumulated debris can reduce the performance of the agitator in a variety of ways. For example, debris may cover the agitation bristles and diminish the agitator's ability to agitate a surface. Further, debris on the agitator may impede the rotation of the agitator by wrapping around the axle or by creating additional friction with the cleaning head. If not removed, such debris can also accumulate on or migrate to the ends of the agitator and enter the bearing areas where it may cause binding, remove bearing lubrication, or otherwise generate high friction, excessive heat, or other undesirable conditions that can damage the bearings or mounting structure. In addition, debris collected on the agitator may create an imbalance in the agitator that may result in sound and/or vibrations when the agitator rotates.

Debris that has collected on an agitator is often difficult to remove because it has wrapped tightly around the agitator and intertwined with the bristles. Users of a cleaning device often must invert the device and remove the debris with manual tools such as knives, scissors or other implements. Manual removal can be unsanitary, time consuming and, if the user fails to follow instructions to deactivate the vacuum, may expose the user to contact with a moving agitator.

Some known devices use mechanisms and features to facilitate removing elongated fibers, such as string and hair, that may become wrapped around an agitator during use. For example, some agitators are provided with integral grooves that allow access by a pair of scissors or a knife blade to manually cut the fiber. Other cleaning devices use comb-like mechanisms to attempt to remove fibers. One example is shown in U.S. Pat. No. 2,960,714, which is incorporated herein by reference.

Still other devices, such as those shown in U.S. application Ser. No. 12/405,761, filed on Mar. 17, 2009 (Publication No. US 2009/0229075), which is incorporated herein by reference, use a movable blade to selectively press against the agitator to sever or abrade fibers. In the device in U.S. application Ser. No. 12/405,761, the agitator is provided with a raised support surface that provides a firm backing against which the blade presses to pinch and cut the fibers. Devices such as those in U.S. application Ser. No. 12/405,761 have been found to be effective for simple and durable user-friendly cleaning.

While various features of vacuum cleaner agitators and agitator cleaning devices are known, there still exists a need to provide alternatives, modifications, and improvements to such devices.

SUMMARY

In one exemplary embodiment, there is provided a vacuum cleaner having a base, an agitator rotatably mounted to the base, a motor operatively associated with the base and configured to rotate the agitator, an agitator cleaner mounted adjacent the agitator, first and second support assemblies configured to collectively support the base on a surface to be cleaned, and an actuator. The agitator cleaner is movable between a first position in which the agitator cleaner is spaced from the agitator, and a second position in which the agitator cleaner engages the agitator while the agitator is being rotated by the motor to remove debris from the agitator. The first support assembly is movable between a raised position in which the agitator is proximal to the surface and a lowered position in which the agitator is spaced from the surface. The actuator is mounted on the base to be movable between an idle position and an operative position. The actuator includes a first controller operatively associated with the agitator cleaner to move the agitator cleaner into the first position when the actuator is in the idle position, and a second controller operatively associated with the first support assembly to move the first support assembly to the lowered position when the actuator is in the operative position.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

FIG. 2A is an isometric view of the base of the vacuum cleaner of FIG. 1, shown with a top cover removed and an agitator cleaner in the idle position.

FIG. 2B is an isometric view of the base of the vacuum cleaner of FIG. 1, shown with a top cover removed and an agitator cleaner in the operative position.

DETAILED DESCRIPTION

Figure 1:
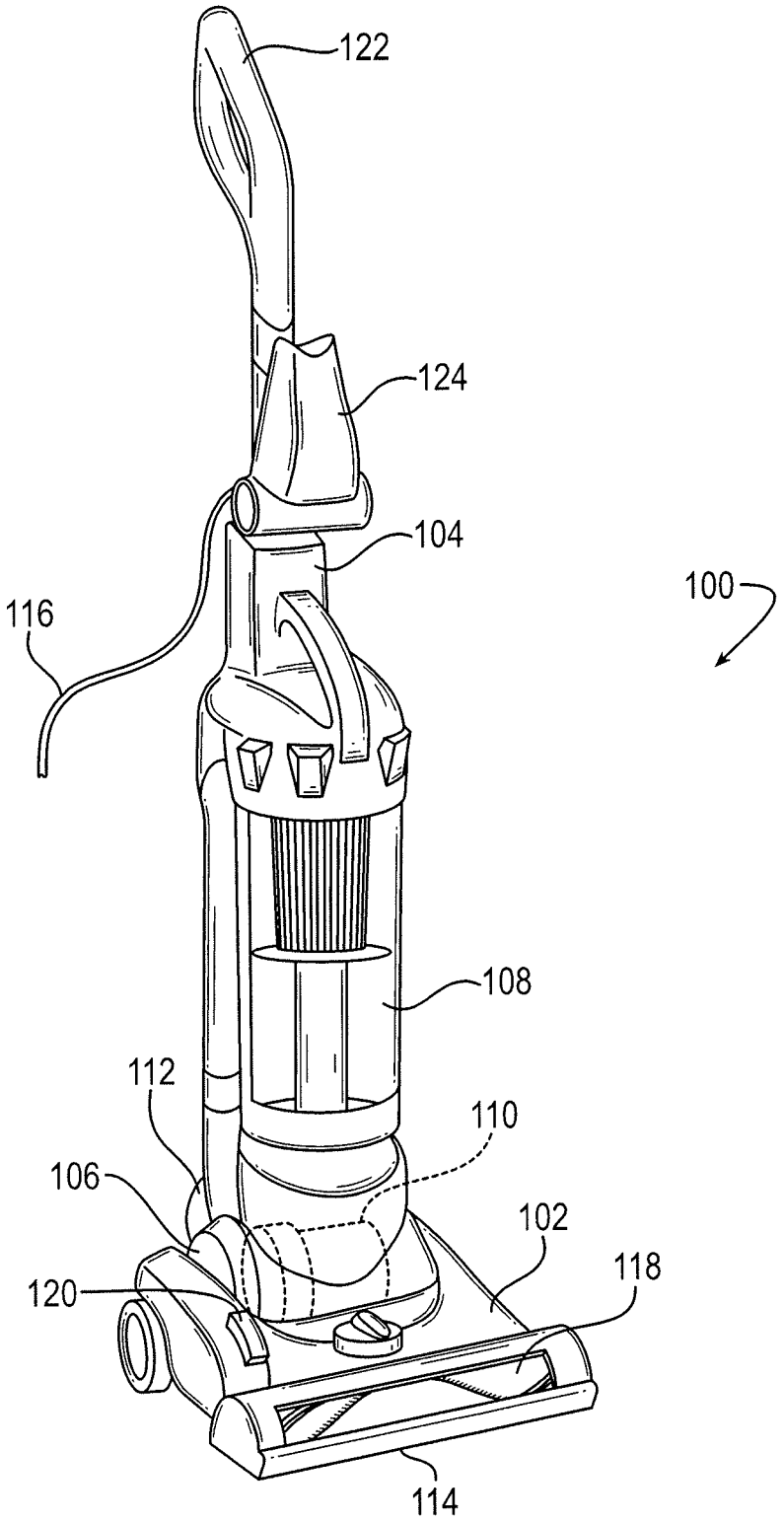
FIG. 1 is an isometric view of an exemplary upright vacuum cleaner that may incorporate one or more aspects of the present invention.

An exemplary embodiment of an upright vacuum cleaner 100 is shown in FIG. 1. In general, the vacuum cleaner 100 includes a base 102, a handle 104, and a pivot joint 106 connecting the base 102 to the handle 104.

The exemplary handle 104 includes a dirt collector 108, such as a bag chamber or cyclone separator, and a suction motor 110 (i.e., a combined impeller and electric motor) configured to suck air through the dirt collector 108. The handle 104 is connected to the base 102 by a suction hose 112, and the suction hose 112 is fluidly connected to a suction inlet 114 located on the bottom of the base 102. The vacuum cleaner 100 may be powered by a battery pack, a cord 116 to a household power supply, a combination of the foregoing, or the like.

The exemplary base 102 includes a rotating floor agitator 118 and an agitator cleaner (200, FIG. 2A). These may be visible to the user through a window or transparent housing on the surface of the base 102. A pedal 120 or other actuator mechanism may be provided to operate the agitator cleaner 200. Details of the agitator 118 and agitator cleaner 200 are provided below.

The pivot joint 106 joins the base 102 to the handle 104 to allow relative movement therebetween. The pivot joint 106 may provide a single pivot axis (e.g., tilting back and forth about a pivot that extends in the lateral direction) or multiple pivot axes (e.g., tilting about a laterally-extending pivot axis and swiveling about a long axis of the handle 104 or rotating about a second pivot axis that extends in the fore-aft direction). Pivot axes may be defined by bushings, shafts, bearings, and the like, as known in the art. One or more locking mechanisms (not shown) may be provided to selectively prevent the handle 104 from pivoting about one or more axes, in order to hold the handle 104 in an upright position or for other purposes.

The vacuum cleaner 100 may include various other features. For example, the handle 104 may include a grip 122, storage for accessory tools 124, a power switch, a removable cleaning hose and associated wand, and other typical features of upright vacuum cleaners. The vacuum cleaner 100 also may include supplemental filters to provide fine dust separation. Also, the locations of the various working parts, such as the suction motor 110 and dirt collector 108 may be modified, such as by placing one or both in the base 102. Other variations and modifications will be apparent to persons of ordinary skill in the art in view of the present disclosure.

FIGS. 2A and 2B illustrate the exemplary base 102 with the top cover and various other parts removed for clarity. The agitator 118 is rotatably mounted in the base adjacent the agitator cleaner 200 and inside an agitator chamber that opens on the lower end to form the suction inlet 114. The agitator 118 may be mounted to the base 102 by a pair of bearings 202 or other support structures. The agitator 118 also may have a pulley 204 or other driven element, that is connected to and driven be a suitable motor. In some cases, a dedicated motor 246 mounted in the base 102 may be used to drive the agitator 118, but in other cases the agitator 118 may be driven by the suction motor 110. In the latter case, a typical arrangement is to mount the suction motor 110 in the handle (as in FIG. 1), with an extended portion of the suction motor's drive shaft 206 extending through the pivot joint 106 and into an enclosed belt chamber in the base 102. In such devices, a belt 208 may extend directly from the drive shaft 206 to the pulley 204. Other embodiments may use intermediate drive elements joining the drive shaft 206 to the pulley 204. Also, other embodiments may mount the suction motor 110 directly in the base 102.

The agitator 118 comprises a spindle 210 that is rotatably mounted to the base by the bearings 202. A plurality of agitating devices, such as bristles 212 or flaps, extend from the spindle 210 a first radial distance to extend outside the suction inlet 114 to contact an underlying surface. As used herein, the term "radial distance" refers to a distance from the spindle's rotation axis 214 to the furthest point, as measured in a plane orthogonal to the rotation axis 214, on the part in question. The bristles 212 may comprise tufts or rows of fibers. In the shown embodiment, the bristles 212 are provided as two helical rows of spaced fiber tufts. Each row reverses its helical direction at the midpoint of the spindle 210, which may be helpful to prevent the generation of lateral forces during operation and help sweep dirt to a centrally-located suction passage. Other embodiments may be modified in various ways. For example, the spaced tufts may be replaced by an arrangement of fibers that extends continuously along the spindle 210, with periodic gaps as required to avoid contact with support structures that may be located in the base 102 or suction inlet 114. Other embodiments may provide more than two helical rows, use helical rows that do not reverse direction, or reverse direction more than once or at different locations, and so on. Other variations and modifications will be apparent to persons of ordinary skill in the art in view of the present disclosure.

One or more support surfaces 216 also may extend a second radial distance from the spindle 210. The second radial distance is less than the first radial distance, and preferably is not sufficient to reach outside the suction inlet 114. This prevents the support surfaces 216 from striking the underlying surface, but this is not strictly required in all embodiments. The support surfaces 216 preferably are arranged in a pattern that matches the bristles 212, and in this case they are shaped as helixes that reverse direction at about the middle of the spindle's length. This "herringbone" pattern may help distribute loads created by the agitator cleaner 200 and provide other benefits. The support surfaces 216 also preferably extend, without any interruptions and at an essentially constant radial distance, from a first end of each support surface 216 adjacent one end of the spindle 210 to a second end of each support surface 216 located adjacent the other end of the spindle 210. This provides a continuous surface to bear against the agitator cleaner 200 throughout the agitator's full 360° rotation. This prevents the agitator cleaner 200 from moving up and down as the agitator 118 rotates, which may be uncomfortable to the operator and cause premature wear and damage.

Alternative support surfaces 216 may have other shapes, and may have different overall shapes than the agitating devices. The support surfaces 216 may include a series of radial ribs 218 with pockets between adjacent ribs 218 to assist with cleaning. The support surfaces 216 also may include outer surfaces 220 that are formed as segments of a circle centered on the spindle's rotation axis 214, which may encourage contact with the agitator cleaner 200 over a substantial arc of the agitator's rotation. The outer surfaces 220 may all be at the same radial distance from the rotation axis 214, or portions may be at different distances. For example, the left side of one of the two support surfaces 216 may taller than the right side, and the right side of the other support surface 216 may be taller than the left side. This may encourage more efficient cleaning by providing a higher contact force on a single point along each support surface 216 at any given time during rotation. Other variations and modifications will be apparent to persons of ordinary skill in the art in view of the present disclosure. For example, the support surfaces 216 may be omitted or replaced by different structures.

The exemplary agitator cleaner 200 comprises a cleaning member 222 that is connected to a rigid bar 224. The cleaning member 222 preferably comprises a blade-like edge that extends continuously along the portion of the spindle 210 that has bristles 212 or other agitating members extending therefrom. Gaps may be provided in the cleaning member 222 where supports or other structures would otherwise interfere with the cleaning member 222. The cleaning member 222 optionally may be made of a flexible sheet of material, such as metal, to allow some flexure to prevent the generation of excessive force against the support surfaces 216. However, other embodiments may use a cleaning member 222 made of relatively rigid metal, plastic, ceramic or other materials. While it is preferred to have a cleaning member 222 with a continuous straight edge, such as described above and shown in FIG. 1, other embodiments may use serrations or discrete teeth to form some of all of the cleaning member 222.

The bar 224, which may be integral to or separately formed from the cleaning member 222, is pivotally mounted to the base 102 by pivots 226 such as bearings or bushings. The bar 224 includes an actuator, such as a lever 228, that may be manipulated to move the cleaning member 222 into engagement with the bristles 212 to cut, abrade or otherwise remove fibers from the agitator 118. The lever 228 may be operated directly, or through a linkage.

In the exemplary embodiment, the lever 228 is rotated by the pedal 120. The pedal 120 is mounted to the base 102 by a pivot 230. A first end 232 of the pedal 120 is configured to receive an operating force, which may be applied directly or indirectly by a user. For example, the first end 232 may be shaped to receive a user's foot or hand, or may be connected to a drive linkage that is operated by an electric solenoid. A second end 234 of the pedal 120 includes a slot 236 that receives a pin 238 located at a free end of the lever 228. The pivot 230 is located between the first and second ends 232, 234 of the pedal 120, so that a downward force applied to the first end 232 moves the second end 234 upward. As the second end 234 moves upward, the slot 236 and pin 238 also rise. During this movement, the pin 238 (which may have a roller) slides along the slot 236. As the pin 238 rises, it rotates the bar 224, and moves the cleaning member 222 down to engage the agitator 118 to perform the agitator cleaning operation. This operative position is shown in FIG. 2B.

If desired, the amount of force transmitted to the cleaning member 222 to hold it in the operative position may be regulated or limited. For example, the lever 228 may be formed as a leaf spring that flexes to limit the amount of force that can be transmitted between the pedal 120 and the cleaning member 222. Similarly, the cleaning member 222 may be flexible. In these embodiments, a lower surface 236' of the slot 236 may push the pin 238 upwards to generate the force necessary to move the cleaning member 222 to the operative position.

In another embodiment, the force to move the cleaning member 222 to the operative position may be modulated by applying the force with a spring 240 having a predetermined spring constant. In this embodiment a first spring 240 is connected to the agitator cleaner 200 to bias the cleaning member 222 towards the agitator 118, and a second spring 242 is connected to the pedal 120 to bias it towards the idle position. The two springs 240, 242 are shown as coil springs that operate in tension, but other types of spring may be used (e.g., coil springs in compression, torsion springs, leaf springs, elastomer blocks, etc.). In this embodiment, when the second spring 242 holds the pedal 120 in the idle position, an upper surface 236" of the slot 236 presses down on the pin 238 against the bias of the first spring 240 to hold the cleaning member 222 out of engagement with the agitator 118. To maintain this position, the effective force of the second spring 242 must be sufficient to hold the first spring 240 in the extended position. To perform agitator cleaning, the user applies a force (manually or through electromotive means) to overcome the bias of the second spring 242 to move the pedal 120 to the operative position. When the pedal 120 rotates, the slot 236 rises, allowing the first spring 240 to pull the pin 238 upwards to rotate the agitator cleaner 200 to place the cleaning member 222 into contact with the agitator 118, as shown in FIG. 2B. To isolate the cleaning member 222 from the force applied to move the pedal 120, the slot 236 may be oversized so that the lower surface 236' does not contact and push up on the bottom of the pin 238 when the parts are in the operative position. Also, a travel stop 244 may be provided to prevent over-rotation of the pedal 120, which could result in direct application of force on the agitator cleaner 200.

The foregoing exemplary embodiment may be modified in various ways. For example, the pin 238 and slot 236 arrangement may be replaced by a four-bar linkage, or the positions of the pin 238 and slot 236 may be swapped. As another example, the lower surface 236' of the slot 236 may be omitted. Also, the travel stop 244 may be movable (e.g., adjustable or removable) to allow the pedal 120 sufficient rotation for the lower surface 236' to push up on the pin 238 when the parts are in the operative position. This may be desirable to provide the option to clean with a higher force than the first spring 240 can generate, or as a backup in the event the first spring 240 breaks or loses tension. Also, other embodiments may configure the cleaning member 222 for linear reciprocation or other kinds of movement, and other mechanisms may be used to articulate the cleaning member 222. Some such variations are shown in previously-incorporated references, and other variations and modifications will be apparent to persons of ordinary skill in the art in view of the present disclosure.

It has been discovered that the forces applied to operate an agitator cleaning mechanism can be transmitted to the underlying floor surface, possibly resulting in damage to the floor. For example, a relatively large force may be applied to the base 102 by a user stepping on an agitator cleaner pedal 120, such as described above. This force can push the base 102 and agitator 118 into the underlying surface, and contact between the rotating agitator 118 and the surface can damage either the agitator 118 or the surface. Furthermore, even when a large force is not transmitted to the surface (e.g., when a solenoid or the like operates the pedal 120), the agitator cleaning operation may be performed with the rotating agitator 118 constantly brushing against a single spot on the underlying surface, and such prolonged contact can generate sufficient friction heat to damage (e.g., burn or melt) the surface or the agitating devices. Thus, it may be desirable in some embodiments to provide a system to prevent contact between the agitator 118 and the surface during agitator cleaning operations.

Figure 3A:
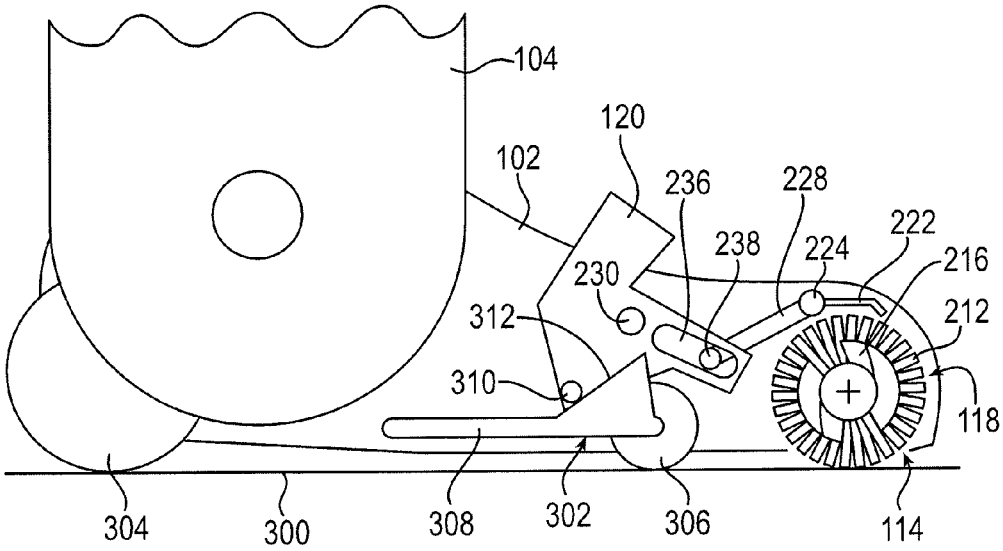
FIG. 3A is a side schematic side view of an exemplary agitator cleaning system shown in the idle position.
Figure 3B:
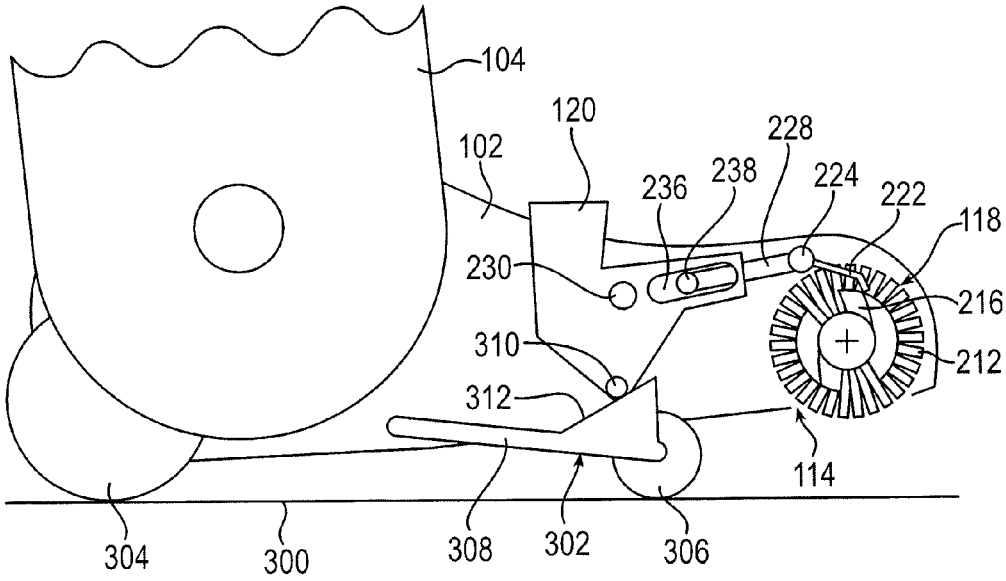
FIG. 3B is a schematic side view of the agitator cleaning system of FIG. 3A, shown in the operative position.

FIGS. 3A and 3B schematically illustrate an exemplary agitator cleaning system having a mechanism to disengage the agitator 118 from the underlying floor surface 300 during agitator cleaning. FIG. 3A shows the system in the idle position, and FIG. 3B shows the system in the operative position.

In this embodiment (which may be integrated into the embodiment of FIGS. 2A and 2B or into other embodiments, or used separately), the vacuum cleaner base 102 is supported on the surface 300 by a front support assembly 302 and a rear support assembly 304. The front and rear support assemblies 302, 304 cooperate to define a stable platform to hold the base 102 at a predetermined orientation on the surface 300. The front and rear support assemblies 302, 304 each may comprise one or more wheels, rollers, casters, skids, or the like, as known in the art. In the shown example, the front support assembly 302 includes one or more wheels 306 that are mounted to the base 102 on a movable support, such as the shown pivot arm 308, to selectively position the wheels 306 at different vertical distances with respect to the rest of the base 102. When the front support assembly 302 is raised to position the wheels 306 relatively close to the rest of the base 102 (FIG. 3A), the base 102 rests with the agitator 118 closer to the surface 300. When the front support assembly 302 is lowered to position the wheels 306 relatively far from the rest of the base 102 (FIG. 3B), the base 102 rests with the agitator 118 farther from the surface 300. In the position of FIG. 3B, the agitator 118 preferably is far enough from the surface 300 that the agitator 118 will not contact typical carpets and other floor coverings. The pivot arm 308 may be connected to the rest of the base 102 by a spring (not shown) to bias the wheels 306 into the raised position, as known in the art. The construction of such movable supports for vacuum cleaner bases is known in the context of height adjustment mechanisms to position the suction inlet to clean different height carpets, and "kick-up" mechanisms to lift the agitator out of contact with the underling surface when the handle is placed into the upright position for accessory cleaning. Examples of such devices are shown, for example, in U.S. Pat. Nos. 3,683,448; 4,446,594; 5,974,625; 6,363,573; and 7,246,407, which are incorporated herein by reference. The agitator 118 is mounted to the base 102 in front of the front wheels 306, but may be located elsewhere.

The front support assembly 302 may be moved into the lowered position during agitator cleaning operations to prevent the agitator 118 from potentially damaging (or being damaged by) the underlying surface 300. To do so, the pedal 120 may include a driving member that acts on the front support assembly 302 to move the wheels 306 from a raised position (FIG. 3A) to a the lowered position (FIG. 3B). For example, the pedal 120 may include a pin 310 that is mounted at a radial distance from the pedal's pivot 230, so that the pin 310 travels through an arc as the pedal 120 rotates. The pin 310 contacts a driven member, such as a ramp 312, located on the front support assembly 302, and applies a force to move the ramp 312 and the rest of the front support assembly 302 downwards as the pin 310 rotates with the pedal 120. The pin 310 may comprise a roller or bushing to reduce friction, and the parts may be made of relatively durable materials to ensure longevity and smooth operation over many cycles.

It will be appreciated that the front support assembly 302 may double as a height adjusting mechanism, and in this case, the pin 310 may be spaced from the ramp 312 when the pedal 120 is idle and the front support assembly 302 is adjusted down to for cleaning high carpets. However, upon moving the pedal 120 to the operative position, any gap between the pin 310 and the ramp 312 will be closed prior to the pin 310 forcing the ramp 312 down further. It is also envisioned that the highest setting of the height adjustment mechanism may be sufficient to place the front support assembly 302 in the position shown in FIG. 3B, in which case the pin 310 is still operatively associated with the front support assembly 302, but is only necessary and used when the height adjustment mechanism is left in settings that do not place the front support assembly 320 in the position of FIG. 3B.

The foregoing embodiment may be modified in various ways. For example, the locations of the pin 310 and ramp 312 may be swapped, or they may be replaced with different driving and driven devices (e.g., a pushrod or linkage). The driven device also may comprise a pre-existing part of the front support assembly 302. For example, the driving member may press down on the front wheel 306 or its axle, or on a part that is also used with a height adjusting mechanism for the suction inlet. Also, the front support assembly 302 may be indirectly driven by the pedal 120. For example, the driving member may rotate a pre-existing height adjustment knob that raises and lowers the front support assembly 302, or it may contact a microswitch that activates a solenoid that drives the front support assembly 302 downward. Also, in other embodiments, the front support assembly 302 may be a part or assembly that is separate from a pre-existing front wheel carriage that is used to adjust the height of the suction inlet during normal use. It is also envisioned that the movable front support assembly 302 may be replaced by a movable rear support assembly 304, or both of the support assemblies 302, 304 may be movable. Other variations and modifications will be apparent to persons of ordinary skill in the art in view of the present disclosure.

Figure 4A:
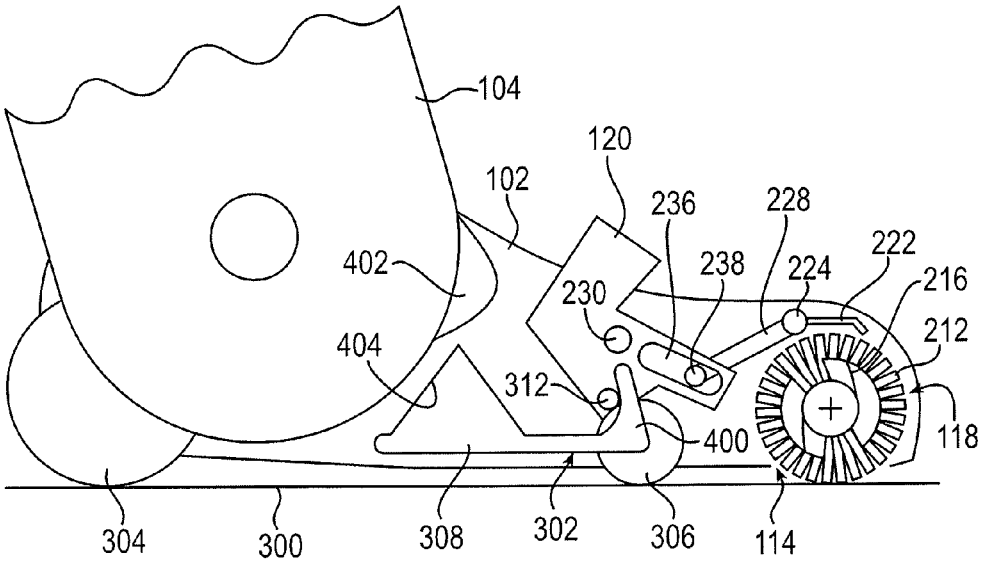
FIG. 4A is a side schematic side view of another exemplary agitator cleaning system shown in the idle position.
Figure 4B:
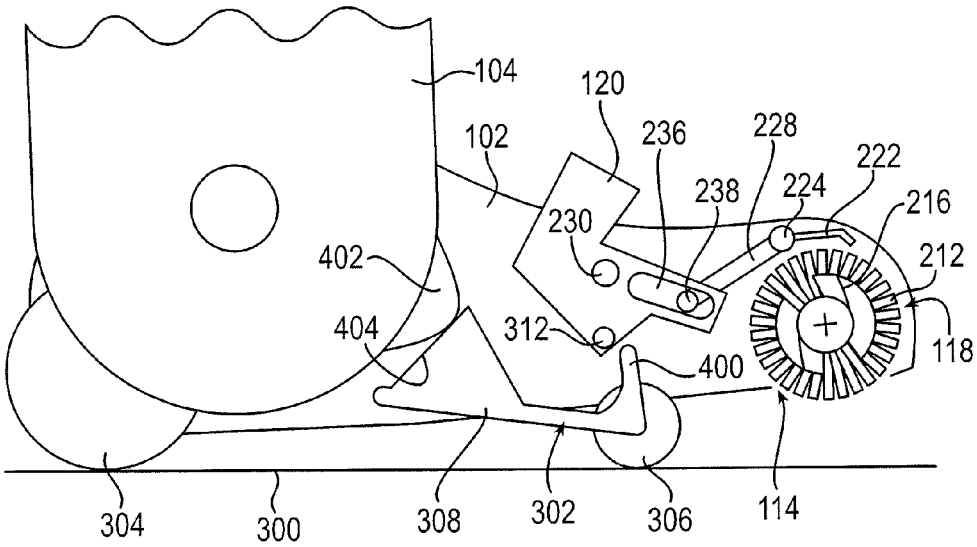
FIG. 4B is a schematic side view of the agitator cleaning system of FIG. 4A, shown in the operative position.

The foregoing embodiments describe ways to lift the agitator 118 relative to the surface 300 as part of the agitator cleaning operation. In other embodiments, the agitator cleaning mechanisms may be disabled until some other mechanism is used to raise the agitator 118 out of engagement with the floor surface 300. For example, In the embodiment of FIGS. 4A and 4B, the front support assembly 302 may include a blocker 400 that prevents the pedal 120 from moving out of the idle position until the front support assembly 302 has reached a predetermined lowered position. Thus, agitator cleaning operations cannot be performed until the front support assembly 302 is lowered by some other mechanism to the lowered position shown in FIG. 4B. Any other conventional device may be used to lower the front support assembly 302 to the lowered position. For example, the handle 104 may include a driving member, such as a radial protrusion 402, and the front support assembly 302 may have a corresponding driven member, such as a ramp 404. When the handle 104 is leaned back for normal floor cleaning, the radial protrusion 402 does not engage the ramp 404, and the front support assembly 302 is free to rise up to place the agitator 118 close to the surface 300, as shown in FIG. 4A. In this position, the blocker 400 impedes the pin 310 and prevents the pedal 120 from being moved to perform agitator cleaning. When the handle 104 is tilted forward, the radial protrusion 402 presses against the ramp 404, to place the front support assembly 302 in the lowered position, as shown in FIG. 4B. In this position, the blocker 400 does not impede the pin 310, and the user is free to depress the pedal 120 to perform agitator cleaning operations.

The foregoing embodiment may be modified in various ways. For example, a conventional nozzle height adjustment mechanism may be used to move the front support assembly 302 into the lowered position of FIG. 4B to permit agitator cleaning. Other variations and modifications will be apparent to persons of ordinary skill in the art in view of the present disclosure.

Still other embodiments may lift the agitator 118 out of engagement with the surface 300 without necessarily repositioning the rest of the base relative the surface 300. For example, in the embodiment of FIGS. 5A and 5B, the agitator 118 may be mounted to the base 102 on a pivot arm 500. Arrangements for mounting an agitator in this manner are known in the art, and described, for example, in U.S. Pat. No. 6,286,180, which is incorporated herein by reference. In this embodiment, the pedal 120 may be connected to the agitator pivot arm 500 by a linkage 502. When the pedal 120 is in the idle position, shown in FIG. 5A, the agitator 118 extends outside the base 102 and can contact the underlying surface 300. When the pedal is depressed to the operative position, the pedal 120 rotates the linkage 502 and lifts the agitator 118 into the base 102 where it can no longer contact the surface 300, as shown in FIG. 5B. In this embodiment, the pedal 120 also may rotate the agitator cleaner 200 towards the agitator 118 (as in the embodiments illustrated above), but alternatively, the agitator cleaner 200 may be fixedly mounted in the base 102 at a location where the elevated agitator 118 comes into contact with it to perform the cleaning operation. As in some foregoing embodiments, the user can depress the pedal 120 to simultaneously remove the agitator 118 from contact with the surface 300, and initiate the agitator cleaning process.

Figure 5A:
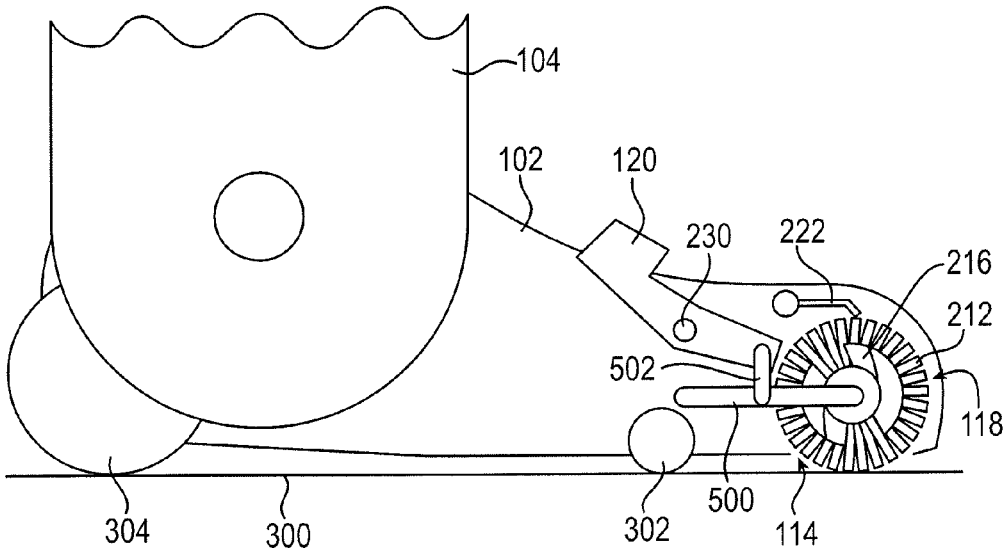
FIG. 5A is a side schematic side view of another exemplary agitator cleaning system shown in the idle position.
Figure 5B:
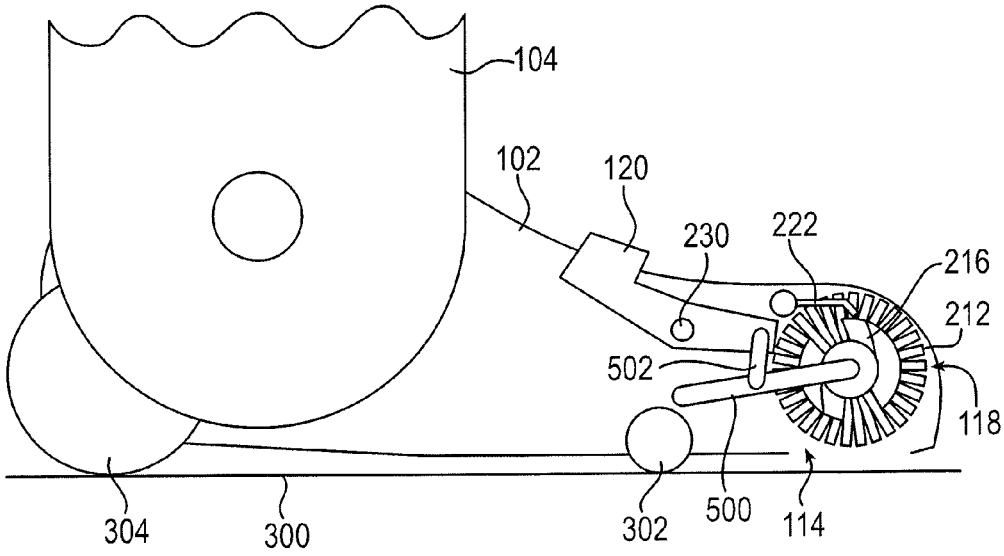
FIG. 5B is a schematic side view of the agitator cleaning system of FIG. 5A, shown in the operative position.

As with other embodiments shown herein, the embodiment of FIGS. 5A and 5B also can be modified in various ways. For example, the agitator pivot arm 500 may be part of or connected to a height adjusting mechanism that is used to tune the agitator's height to particular floor surfaces. Other variations and modifications will be apparent to persons of ordinary skill in the art in view of the present disclosure.

Figure 6:
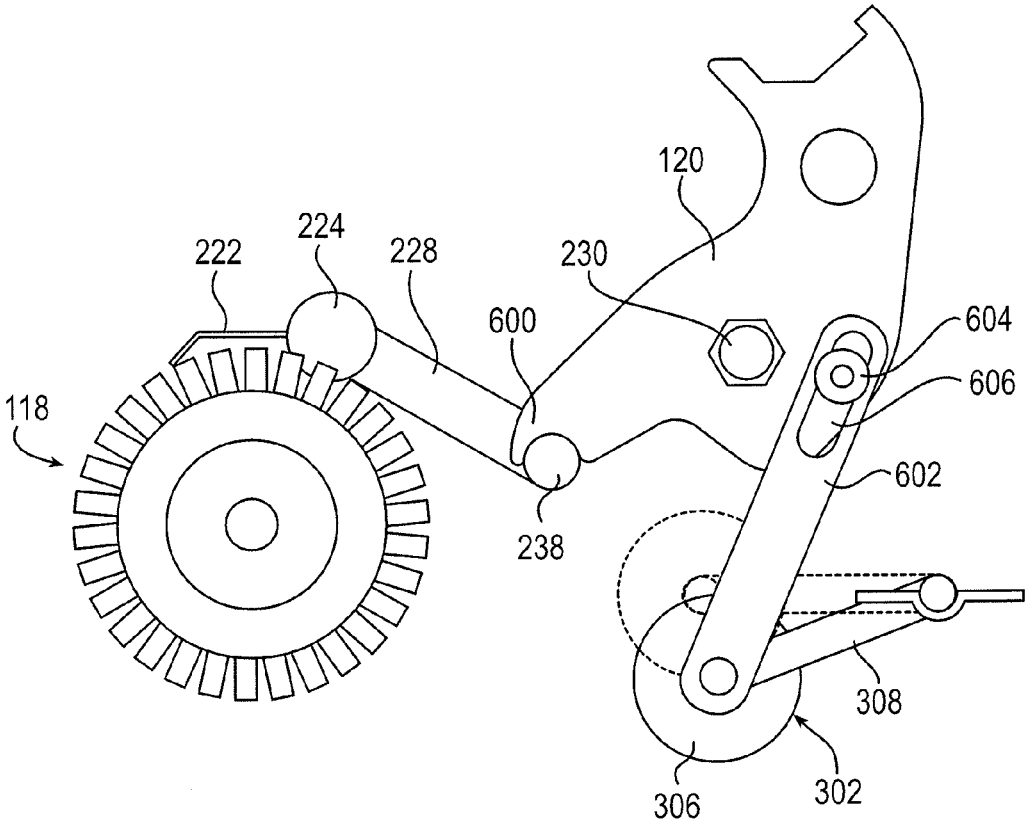
FIG. 6 illustrates a further exemplary agitator cleaning system.

FIG. 6 illustrates another example of an agitator cleaning mechanism. The base 102 is removed from this view for clarity of illustration. In this example, the pedal 120 has a hook-shaped protrusion 600 that moves the agitator cleaner pin 238 down (as shown) to hold the cleaning member 222 out of engagement with the agitator 118. The pedal 120 is mounted on a pivot 230, so that depressing the end of pedal 120 lifts the protrusion 600 to allow a spring (e.g. spring 240 in FIGS. 2A-2B) to pull the cleaning member 222 into engagement with the agitator 118. The pedal 120 also includes a pushrod 602 that moves the front support assembly 302 downwards when the pedal 120 is depressed. The pushrod 602 is operated by a pin 604 that is mounted on the pedal 120. The pin 604 fits in a slot 606 that allows a limited amount of pedal rotation before the pin 604 presses on the pushrod 602 to displace the front support assembly 302. The distal end of the pushrod 602 is connected to the pivot arm 308 via a pivoting arrangement or other suitable mechanism. When the pedal 120 is returned to the idle position, the pin 604 pulls back up on the pushrod 602 to lift the front support assembly back towards the base 102, to place the agitator 118 closer to the surface for floor cleaning operations. The free travel provided by the slot 606 allows the front support assembly 302 to move up and down by a predetermined distance when the pedal 120 is in the idle position, and thereby allows the front support assembly 302 to be manipulated by a conventional height-adjusting device during floor cleaning operations. In devices in which such a height-adjusting mechanism is not desired or other means to provide relative free movement are provided, the slot 606 may be omitted. Alternative variations may use other mechanisms, such as a cable, to lift the front support assembly. Other variations and modifications will be apparent to persons of ordinary skill in the art in view of the present disclosure.

The exemplary embodiments are described herein in the context of an upright vacuum cleaner, but it will be readily apparent that other embodiments may be used in stick vacuums, canister or central vacuum cleaner powerheads, robotic vacuum cleaners, wet extractors, and other cleaning devices having rotating agitators that are likely to experience fouling by wrapped fibers. Furthermore, the embodiments described herein may be combined together, if desired (e.g., features of FIGS. 3A-3B may be combined with features of FIGS. 4A-4B). Other variations and modifications will be apparent to persons of ordinary skill in the art in view of the present disclosure.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

What is claimed:

1. A vacuum cleaner comprising:

a base;

an agitator rotatably mounted to the base;

a motor operatively associated with the base and configured to rotate the agitator;

an agitator cleaner mounted adjacent the agitator and movable between a first position in which the agitator cleaner is spaced from the agitator and a second position in which the agitator cleaner engages the agitator while the agitator is being rotated by the motor to remove debris from the agitator;

a first support assembly and a second support assembly configured to collectively support the base on a surface to be cleaned, wherein the first support assembly is movable between a raised position in which the agitator is proximal to the surface and a lowered position in which the agitator is spaced from the surface; and an actuator mounted on the base to be movable between an idle position and an operative position, the actuator comprising:

a first controller operatively associated with the agitator cleaner to move the agitator cleaner into the first position when the actuator is in the idle position, and a second controller operatively associated with the first support assembly to move the first support assembly to the lowered position when the actuator is in the operative position.

2. The vacuum cleaner of claim 1, wherein the motor is mounted to the base.

3. The vacuum cleaner of claim 1, further comprising a handle pivotally connected to the base, and wherein the motor is mounted in a handle.

4. The vacuum cleaner of claim 3, wherein the motor comprises a suction motor.

5. The vacuum cleaner of claim 1, wherein the actuator comprises a foot pedal.

6. The vacuum cleaner of claim 1, wherein the agitator cleaner comprises a first spring configured to exert a first force on the agitator cleaner to bias the agitator cleaner towards the second position when the actuator is moved from the idle position to the operative position.

7. The vacuum cleaner of claim 6, wherein the actuator comprises a second spring configured to exert a second force on the actuator to bias the actuator towards the idle position.

8. The vacuum cleaner of claim 1, wherein the first controller is further operatively associated with the agitator cleaner to move the agitator cleaner into the second position when the actuator moves from the idle position to the operative position.

9. The vacuum cleaner of claim 1, wherein the first controller comprises a slot, a pin positioned in the slot, and a lever connected to the pin.

10. The vacuum cleaner of claim 9, wherein the slot is in the actuator and the lever is connected to the agitator cleaner.

11. The vacuum cleaner of claim 1, wherein the second controller comprises a driving member on the actuator and a driven member on the first support assembly.

12. The vacuum cleaner of claim 11, wherein the first support assembly comprises one or more wheels mounted on pivot arm.

13. The vacuum cleaner of claim 12, wherein the driven member comprises a ramp on the pivot arm.

14. The vacuum cleaner of claim 1, wherein the second support assembly comprises one or more wheels.

15. The vacuum cleaner of claim 1, wherein the agitator extends along a longitudinal direction and is configured to rotate about a rotation axis that is parallel to the longitudinal direction, and the agitator cleaner comprises a cleaning blade that extends in the longitudinal direction.

16. The vacuum cleaner of claim 1, wherein the agitator comprises:

a spindle extending along a longitudinal direction from a first spindle end to a second spindle end, and being rotatable about a rotation axis that is parallel with the longitudinal direction;

agitating devices arranged between the first spindle end and the second spindle end and projecting a first radial distance from the rotation axis; and one or more support surfaces projecting a second radial distance from the rotation axis, the second radial distance being less than the first radial distance.

17. The vacuum cleaner of claim 16, wherein the agitating devices comprise at least one helical row of bristles.

18. The vacuum cleaner of claim 16, wherein the one or more support surfaces comprise at least one helical protrusion.

19. The vacuum cleaner of claim 18, wherein the one or more support surfaces extend continuously at a uniform second radial distance from a first support surface end adjacent the first spindle end to a second support surface end adjacent the second spindle end.

20. The vacuum cleaner of claim 16, wherein:

the agitator is mounted in the base adjacent an inlet nozzle;

the agitating devices extend through the inlet nozzle when the spindle rotates; and the one or more support surfaces do not extend through the inlet nozzle when the spindle rotates.

* * * * *